US007789680B2

(12) United States Patent
Hiew et al.

(10) Patent No.: US 7,789,680 B2
(45) Date of Patent: Sep. 7, 2010

(54) USB DEVICE WITH CONNECTED CAP

(75) Inventors: Siew S. Hiew, San Jose, CA (US); Nan Nan, San Jose, CA (US); Abraham C. Ma, Fremont, CA (US)

(73) Assignee: Super Talent Electronics, Inc., San Jose, CA (US)

( * ) Notice: Subject to any disclaimer, the term of this patent is extended or adjusted under 35 U.S.C. 154(b) by 0 days.

(21) Appl. No.: 12/487,523

(22) Filed: Jun. 18, 2009

(65) Prior Publication Data

US 2009/0258516 A1 Oct. 15, 2009

Related U.S. Application Data

(63) Continuation-in-part of application No. 11/901,604, filed on Sep. 17, 2007, now Pat. No. 7,547,218, and a continuation-in-part of application No. 11/773,830, filed on Jul. 5, 2007, and a continuation-in-part of application No. 12/419,187, filed on Apr. 6, 2009.

(51) Int. Cl.
*H01R 13/44* (2006.01)

(52) U.S. Cl. ..... 439/142

(58) Field of Classification Search ..... 439/142, 439/136

See application file for complete search history.

(56) References Cited

U.S. PATENT DOCUMENTS

| | | | | |
|---|---|---|---|---|
| 4,671,587 | A * | 6/1987 | Lerner et al. | 439/142 |
| 5,385,479 | A * | 1/1995 | Okada | 439/144 |
| 5,754,397 | A * | 5/1998 | Howell et al. | 361/679.44 |
| 7,462,044 | B1 * | 12/2008 | Regen et al. | 439/131 |
| 7,473,112 | B2 * | 1/2009 | Zhu et al. | 439/142 |
| 2003/0207601 | A1 * | 11/2003 | Adachi | 439/135 |

* cited by examiner

*Primary Examiner*—Gary F. Paumen
(74) *Attorney, Agent, or Firm*—Bever, Hoffman & Harms, LLP; Patrick T. Bever

(57) ABSTRACT

A USB device including a housing and a protective cap that are slidably and/or pivotably connected together such that the protective cap is able to slide and/or pivot between an open position, in which a plug connector extending from the front of the housing is exposed for operable coupling to a host system, and a closed position, in which the protective cap is disposed over the front end portion of the housing to protect the plug connector. A pivoting/sliding mechanism is provided on the housing and cap that secures the protective cap to the housing at all times, including during transitional movements of the protective cap between the opened and closed positions.

14 Claims, 13 Drawing Sheets

USB DEVICE WITH CONNECTED CAP

RELATED APPLICATIONS

This application is continuation-in-part of U.S. Patent application for "Plug And Cap For A Universal-Serial-Bus (USB) Device", U.S. application Ser. No. 11/901,604, filed on Sep. 17, 2007 which issued as U.S. Pat. No. 7,547,218.

This application is also a CIP of U.S. Patent aApplication for "Molding Method to Manufacture Single-Chip Chip-On-Board USB Device", U.S. application Ser. No. 11/773,830 filed Jul. 5, 2007.

This application is also a CIP of U.S. Patent application for "ESD Protection For USB Memory Devices", U.S. application Ser. No. 12/419,187 filed Apr. 6, 2009.

FIELD OF THE INVENTION

This invention relates to portable electronic devices, and more particularly to portable electronic devices such as those that utilize the Universal-Serial-Bus (USB) specification.

BACKGROUND OF THE INVENTION

In the past, confidential data files were stored in floppy disks or were delivered via networks that require passwords or that use encryption coding for security. Confidential documents can be sent by adding safety seals and impressions during delivering. However, the aforesaid are exposed to the risks of breaking of the passwords, encryption codes, safety seals and impressions, thereby resulting in unsecure transfer of information.

More recently, there is an ongoing trend towards the use of miniaturized, portable computer peripheral devices to store confidential data. In certain cases, such peripheral devices have been reduced to "pocket size", meaning that they can literally be carried in a user's pocket in the same manner as a wallet or set of keys. One example of particular interest, in which context the present invention will be described herein, is a "flash disk", "Universal Serial Bus (USB) flash drive", or simply "USB device".

The proliferation of portable computer peripheral devices, such as USB flash drives, has made the production of USB flash drives very cost sensitive. For example, there is currently a strong demand for high quality USB devices that are very low in cost. Accordingly, there is an ever increasing need for computer peripheral devices that are reliable and inexpensive to produce.

A problem associated with USB devices is that the USB (male) plug connector must be kept covered when not in use in order to prevent contamination of the contact pads, which would prevent the USB device from operating properly when plugged into a (female) plug socket connected to a host system. A conventional inexpensive solution is to provide a removable cap that is snap coupled to the USB device over the plug connector when the USB device is not in use, and completely detached from the USB device when the USB device is plugged into a host system. A problem with such conventional USB device structures is that, when the cap is detached to facilitate operation, the cap can become lost, thereby preventing protection of the USB device after operation, leading to possible failure and loss of valuable information.

What is needed is a portable computer peripheral device that overcomes the problems associated with conventional structures. What is particularly needed is a high quality USB device that has a very low production cost, and provides a protective cap that remains reliably attached to the housing body at all times.

SUMMARY OF THE INVENTION

The present invention is directed to a USB device (or other portable computer peripheral apparatus) having a housing and a protective cap that remain slidably and/or pivotably connected together at all times (i.e., such that the protective cap remains secured to the housing (a) in an opened position when the protective cap is positioned along a side of the housing to facilitate connection of the plug connector to a host system during operating periods, (b) in a closed position when the protective cap is positioned over the plug connector when the USB device is not in use, and (c) during movement of the protective cap between the opened and closed positions). The housing is a box-like structure having an inner cavity containing one or more electronic devices (e.g., flash memory, controller, etc.), and the plug connector is electrically connected to the electronic devices and extends through a front opening defined in housing. By facilitating both protection of the plug connector and displacement of the protective cap to facilitate operation of the USB device without requiring separation of the protective cap from the housing, loss of the protective cap during operation becomes impossible, thereby facilitating long operating life of the USB device over conventional USB devices.

According to at least one embodiment of the present invention, the protective cap is a substantially box-like structure having upper and lower walls that remain parallel to upper and lower walls of the housing at all times, thereby providing a low provide package that is easy to store and transport. In addition, the protective cap includes a lower opening facing the housing and a side opening that is defined in one side of the cap, and the protective cap is attached to the housing such that during transition from the closed to the open position, the cap pivots or slides laterally across the front end portion of the housing such that the plug connector passes through the side opening defined in the cap (i.e., the side opening provides clearance for the plug connector when the cap is pivoted from the closed position to the opened position, thereby simplifying the connection mechanism to reduce manufacturing costs). In one embodiment, the housing defines an L-shaped groove along the front portion and a portion of one side of that receive a lower portion of the cap during the transition between opened and closed positions, thereby providing a clearance for the cap that allows the low profile arrangement mentioned above. A front section of the L-shaped groove receives a portion of the protective cap in the closed position, and a side portion of the L-shaped groove receives the cap portion when the cap is in the opened position, thereby maintaining the cap in an overlapped relationship with the housing to provide maximum support. In another embodiment, the housing defines a U-shaped groove that facilitates repositioning the cap over a rear wall of the housing in the opened position. In yet another embodiment, the plug connector and electronic device are mounted on a sled that deploys the plug connector using a press-and-slide button, where a cam mechanism is utilized to move the protective cap from the front of the housing during the deploying operation, and returns the cap to the closed position when the press-and-slide button is slid backward.

According to various embodiments, the sliding/pivoting movement of the protective cap is achieved using one or more pins and one or more openings or grooves that are at least partially integrally molded or formed on the cap and housing to minimize manufacturing costs. In one embodiment, the housing includes a pair of pins that are slidably and pivotably received in slots defined on inward-facing surfaces of the protective cap, and bumps are provided that engage the elongated grooves to hold the cap in the closed position, thereby avoiding undesirable exposure of the plug connector during transport. In another embodiment, the housing defines a groove that receives pins extending from inward facing surfaces of the cap. In another embodiment, the protective cap includes both pins and grooves that facilitate the sliding/pivoting operation. In yet another embodiment, a metal protective cap is connected to a metal outer housing portion by a hinge mechanism that is spring-biased to hold the cap in the opened and closed positions, and the PCBA is mounted on a plastic inner housing portion that is inserted into the metal outer housing portion.

According to various alternative embodiments, the specific USB device packages described herein may be modified to house a conventional PCBA structure, a PCBA constructed using a chip-on-board (COB) process, or a PCBA constructed using a surface-mount technology (SMT) slim type PCBA process. The various structures may also be utilized to produce other types of portable computer peripheral apparatus.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The present invention relates to an improvement in low-profile USB connectors. The following description is presented to enable one of ordinary skill in the art to make and use the invention as provided in the context of a particular application and its requirements. As used herein, directional terms such as "front", "back" "upper", "upwards", "lower", "side", "upward" and "downward" are intended to provide relative positions for purposes of description, and are not intended to designate an absolute frame of reference. In addition, the term "integrally molded" is intended to mean that the subject items are formed together in a single molding process, as opposed to being formed separately and then connected, e.g., by adhesive. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1A:
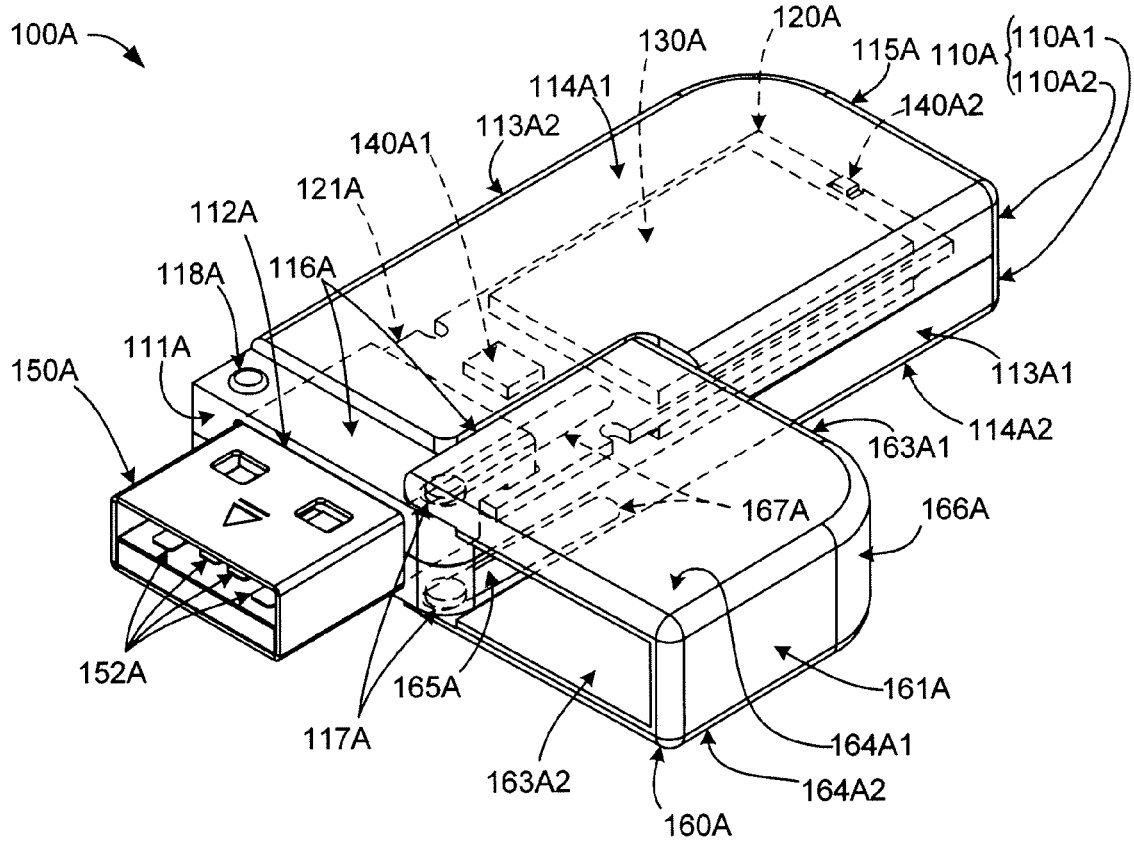
FIGS. 1(A) and 1(B) a perspective views showing an exemplary USB device according to an embodiment of the present invention in deployed and protected positions, respectively.
Figure 1B:
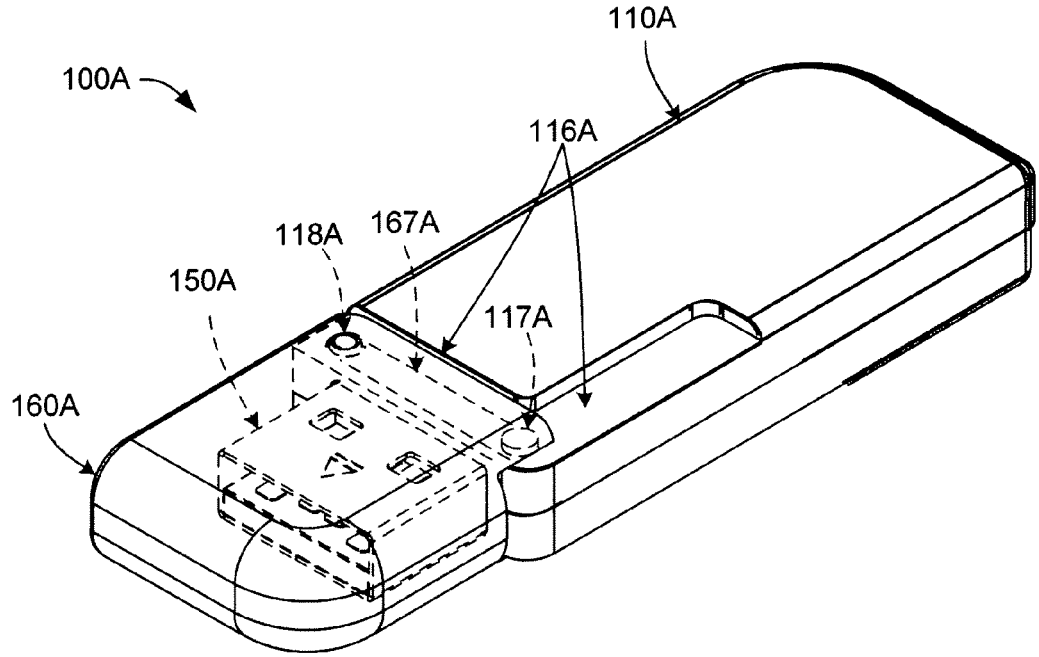
Figure 2:
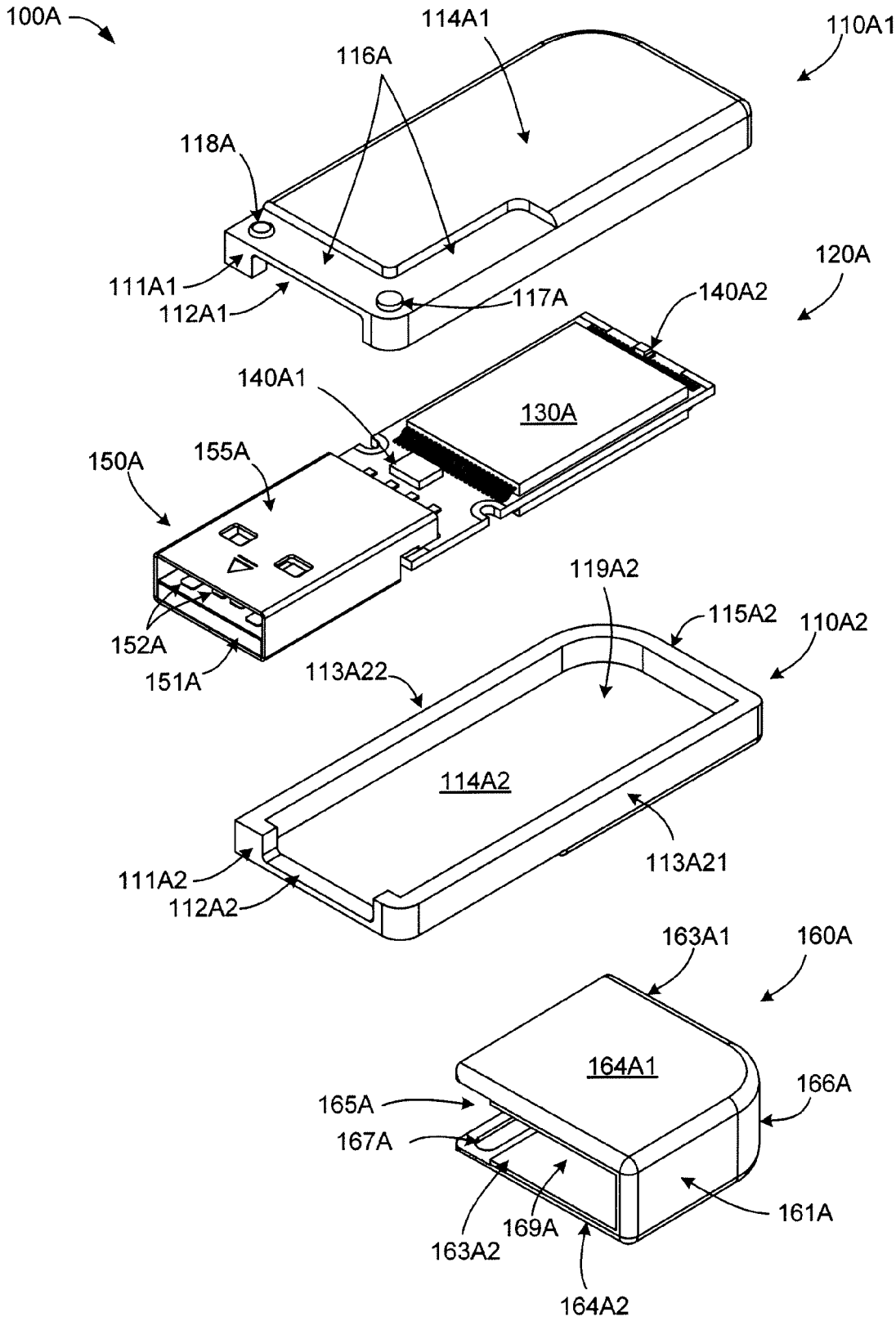
FIG. 2 is an exploded perspective view showing the USB device of FIG. 1 in additional detail.

FIGS. 1(A) and 1(B) are perspective top views showing a Universal-Serial-Bus (USB) device 100A, which represents an exemplary portable computer peripheral apparatus formed in accordance with a first embodiment of the present invention, and FIG. 2 shows USB device 100A in an exploded state. Referring to these figures, USB device 100A generally includes a two-part plastic housing 110A that defines a central cavity, a printed circuit board assembly (PCBA) 120A disposed in the cavity, and having a plug connector 150A that extends through a front opening 112A, and a protective cap 160A that remains connected to housing body 150A at all times. That is, protective cap 160A is pivotably and slidably connected to housing 110A such that protective cap 160A is pivotable between an opened position (shown in FIG. 1(A)) in which protective cap 160A is disposed such that plug connector 150A is exposed for operable coupling to a host system (not shown), and a closed position (shown in FIG. 1(B)) in which protective cap 160A is disposed over plug connector 150A to prevent damage or fouling of plug connector 150A during transportation, e.g., in a user's pocket. Moreover, in accordance with an aspect of the present invention, housing 110A and protective cap 160A are cooperatively constructed such that protective cap 160A remains connected to housing 110A while being moved between the opened and closed positions shown in FIGS. 1(A) and 1(B). By facilitating both protection of plug connector 150A and displacement of protective cap 160A to facilitate operation of USB device 100A without requiring separation of protective cap 160A from housing 110A, loss of protective cap 160A during operation (i.e., when plug connector 150A is inserted into the female socket of a host system, not shown) becomes impossible, thereby facilitating long operating life of USB device 100A in comparison to conventional USB devices.

Referring to FIG. 1(A) and FIG. 2, PCBA 120A includes a printed circuit board (PCB) 121A having at least one electronic device (e.g., a memory die 130A and a controller die, disposed on the bottom surface of PCB 121A) and one or more passive components (e.g., an oscillator 140A1 and an light emitting diode (LED) 140A2). PCB 121A is a substantially flat substrate, and has opposing upper and lower surfaces (the upper surface is facing up in FIGS. 1(A) and 2). Plug connector 150A is attached to a front end of PCB 121A, and, as shown in FIG. 2, includes a substrate 151A having four of metal contacts 152A formed thereon, and a metal plug shell 155A that extends over substrate 151A. Metal contacts 152A are shaped and arranged in a pattern established by the USB specification, and are electronically coupled to electronic device 130A and passive devices 140A1 and 140A2 by way of substrate 151A according to known techniques. Metal plug shell 155A is fixedly mounted onto PCB 121A using known techniques. PCB 121A is formed in accordance with known PCB manufacturing techniques such electronic components 130 and passive components 140A1 and 140A2 are electrically interconnected by a predefined network including conductive traces and other conducting structures that are sandwiched between multiple layers of an insulating material (e.g., FR4) and adhesive.

Referring to FIGS. 1(A) and 2, housing 110A includes an upper housing portion 110A1 and a lower housing portion 110A2 that are sandwiched together and secured using, e.g., an adhesive or double-sided tape. Referring to FIG. 1, upper housing portion 110A1 and lower housing portion 110A2 combined to provide housing 110A with a front wall (front end portion) 111A defining a front opening 112A from which a portion of plug connector 150A extends, opposing side walls 113A1 and 113A2, opposing upper and lower walls 114A1 and 114A2 extending back from the front wall 111A that define the central cavity in which the remainder of PCBA 120A is housed, and a rear wall 115A covering a back portion of the cavity. Referring to FIG. 2, upper housing portion 110A1 and a lower housing portion 110A2 are formed separately and then connected together over a portion of PCBA 120A in the manner described below with reference to FIGS. 3(A) and 3(B). In one embodiment, both upper housing portion 110A1 and lower housing portion 110A2 are formed using known plastic molding techniques. Referring to the lower portion of FIG. 2, lower housing portion 110A2 includes a front wall portion 111A2 that defines a front opening portion 112A2, opposing side wall portions 113A21 and 113A22, rear wall portion 115A2, and lower wall 114A2 that define a first cavity portion 119A2. Upper housing portion 110A1 is substantially a mirror image of lower housing portion 110A2.

Referring to FIG. 1(A) and FIG. 2, protective cap 160A is a single-piece, box-like plastic molded structure including an upper wall 161A and a side wall 163A1 that meet at a rounded corner 166A, and opposing upper and lower walls 164A1 and 164A2 that are integrally molded to upper wall 161A and side wall 163A1 to define a cavity 169A that is accessible by way of a lower opening 165A and a front opening 163A2. In alternative embodiments, protective cap 160A is made using color translucent or opaque molding compounds.

According to an aspect of the present invention, reliable sliding and/or rotating connection of protective cap 160A to housing 110A is achieved by providing pins and grooves that are integrally molded to housing 110A and protective cap 160A. In the present embodiment, housing 110A includes first and second pins 117A that extend from upper wall 114A1 and lower wall 114A2, respectively, and are located adjacent to the front wall 111A, and protective cap 160A includes first and second elongated grooves 167A that are disposed on inside facing surfaces of upper wall 164A1 and 164A2. With this arrangement, when cap 160A is operably mounted onto housing 110A in the manner shown in FIGS. 1(A) and 1(B), each pin 117A enters a corresponding elongated groove 167A such that pins 117A are slidably and pivotably received in their corresponding elongated groove 167A, thereby facilitating the desired connection in a way that minimizes manufacturing costs.

According to another aspect of the present embodiment, protective cap 160A is movably secured to housing 110A such that opposing upper and lower walls 164A1 and 164A2 of cap 160A remain substantially co-planar with the opposing upper and lower walls 114A1 and 114A2 of housing 110A in both the opened position (e.g., shown in FIG. 1(A)) and in the closed position (e.g., shown in FIG. 1(A)), and also while protective cap 160A is disposed between the opened and closed positions. By keeping walls 164A1 and 164A2 of cap 160A co-planar with walls 114A1 and 114A2 of housing 110A at all times, the present invention provides USB device 100A with a low provide package that is easy to store and transport. In the present embodiment, the goal of providing this low profile package is achieved by combining several features. First, protective cap 160A is provided with side opening 163A2 that, as described in additional detail below, provides clearance for plug connector 150A when cap 160A is pivoted from the closed position to the opened position. In addition, housing 110A defines an L-shaped recess 116A that extends along front wall 111A and along a portion of side wall 113A1. Note that L-shaped recess 116A is formed on both upper housing portion 110A1 and lower housing portion 110A2. As shown in FIGS. 1(A) and 1(B), L-shaped recess 116A receives a portion of protective cap 160A when protective cap 160A is in the opened and closed positions, thereby providing the desired low profile arrangement mentioned above.

Figure 3A:
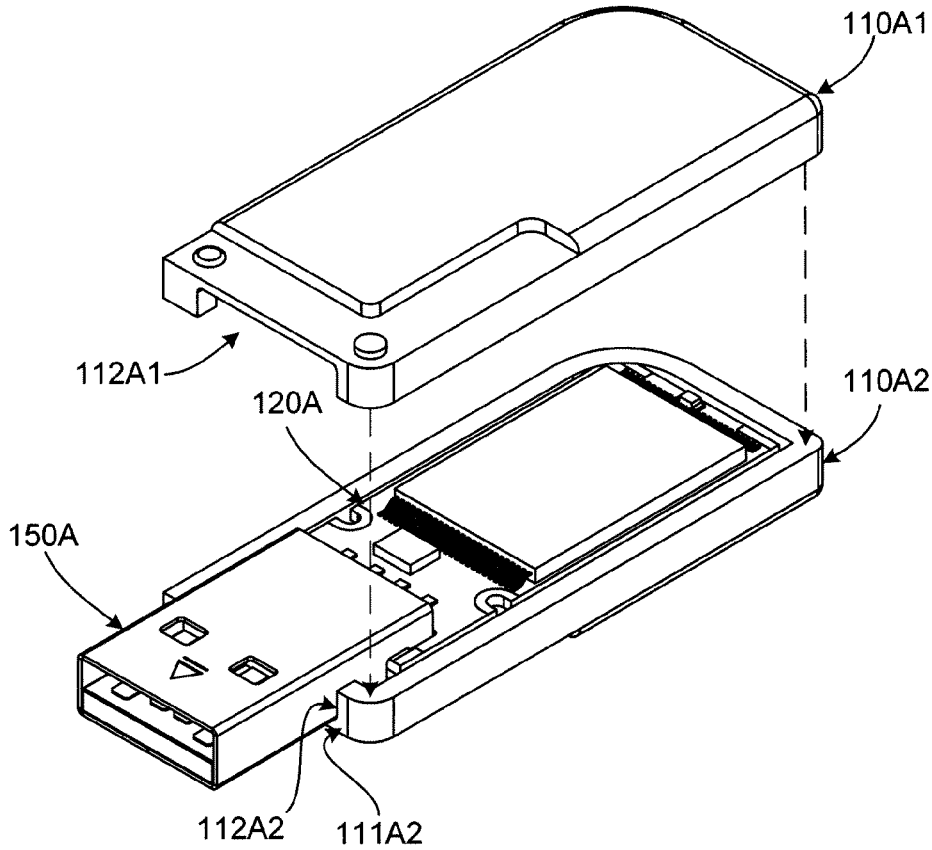
FIGS. 3(A) and 3(B) are exploded perspective views showing the USB device of FIG. 1 during assembly.
Figure 3B:
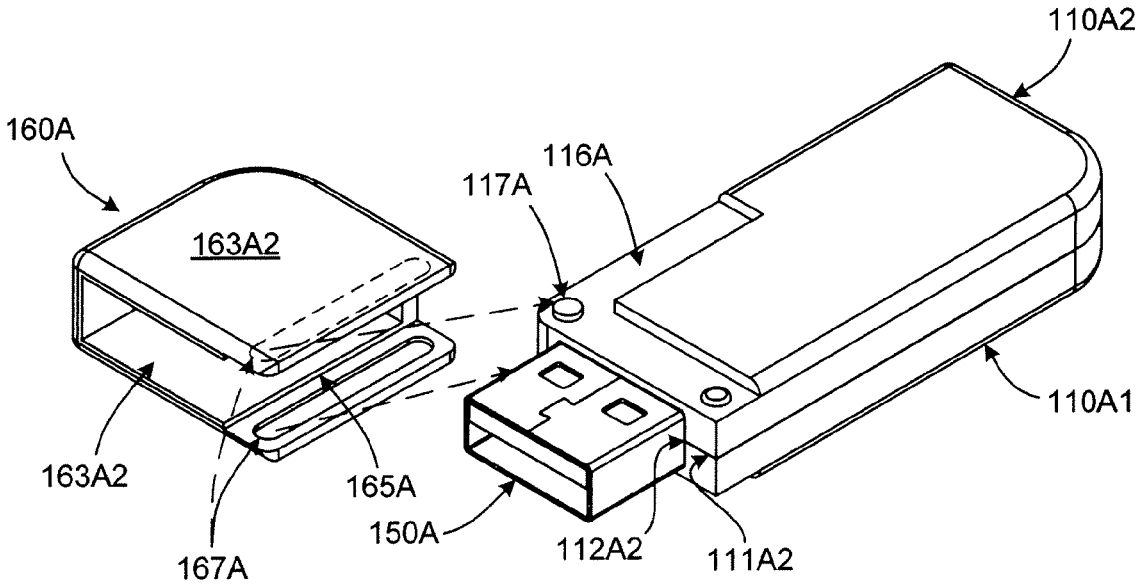

Assembly of USB device 100A is depicted in FIGS. 3(A) and 3(B). As indicated in FIG. 3(A), PBCA 120A is mounted into the cavity portion provided by lower housing portion 110A such that plug connector 150A extends through front opening 112A defined in front wall 111A. Upper housing portion 110A1 is then mounted over PCBA 120A, as indicated by the dashed line arrows is FIG. 3(A), such that its peripheral wall portions match with corresponding peripheral wall portions of lower housing portion 110A2, and such that front opening portion 112A1 is disposed over the upper surface of plug connector 150A. Upper housing portion 110A1 is fixedly and permanently secured to lower housing portion 110A2, e.g., using an adhesive or known welding technique. As indicated in FIG. 3(B), protective cap 160A is then mounted onto the assembled housing by slightly separating upper and lower walls 163A to allow pins 117A to enter elongated grooves 167A as indicated by the dashed line arrows in FIG. 3(B). Note that bending of cap 160A for connection to housing 110A is facilitated by providing cap 160A with both lower opening 165A and side opening 163A2. When fully mounted (e.g., as shown in FIGS. 1(A) and 1(B)), a portion of housing 110A (e.g., front wall 111A in FIG. 1(A)) extends into lower opening 161A of cap 160A, whereby this overlap provides structural rigidity that resists unintentional separation of cap 160A from housing 110A.

Figure 4A:
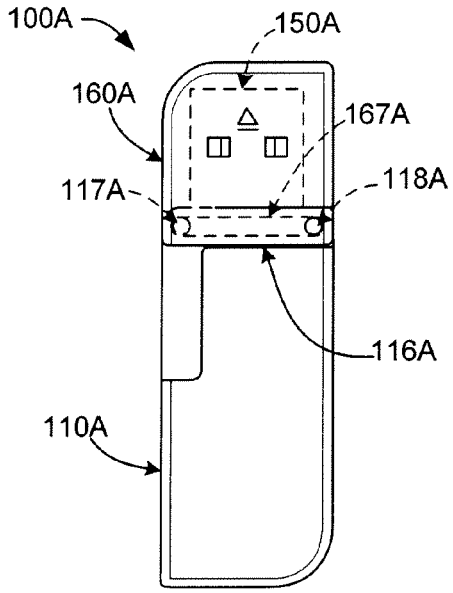
FIGS. 4(A), 4(B), 4(C) and 4(D) are simplified plan views showing the USB device of FIG. 1 during repositioning of the protective cap from a protected (traveling) position to a deployed (operating) position.
Figure 4B:
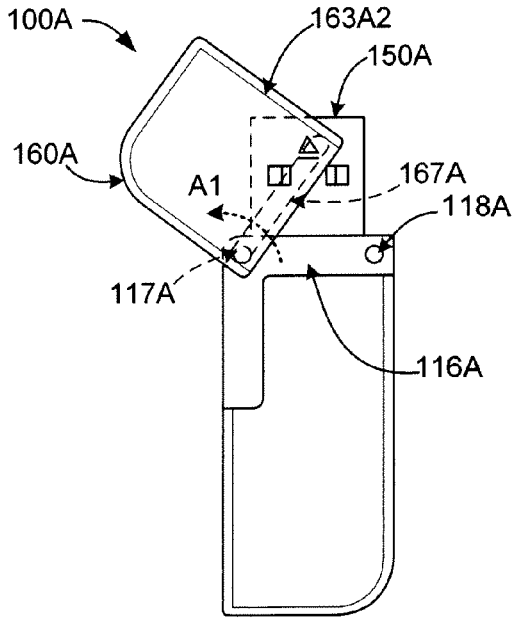
Figure 4C:
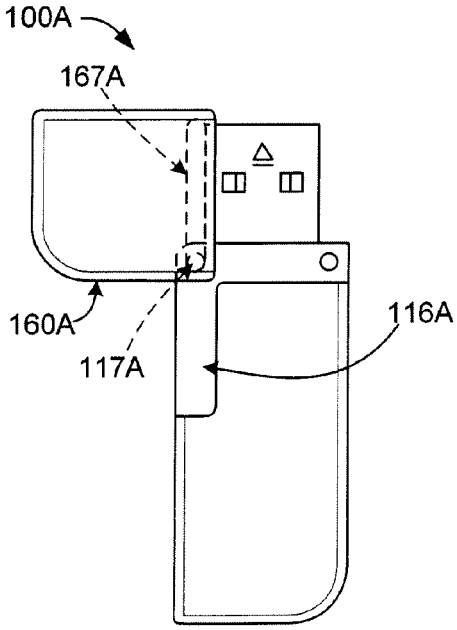
Figure 4D:
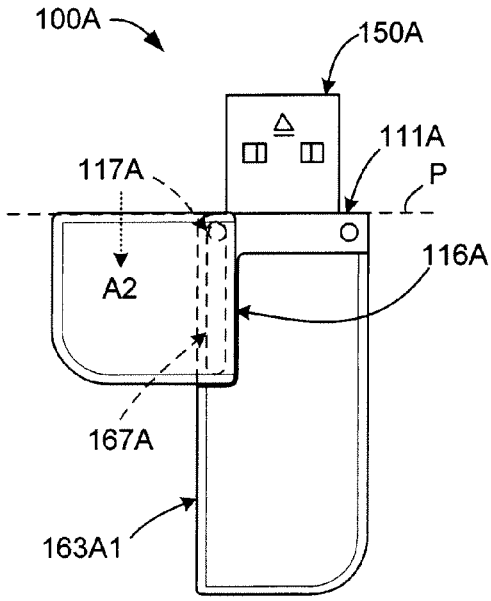

FIGS. 4(A) to 4(D) are simplified top plan views showing USB device 100A during movement of protective cap 160A from the closed to the opened position. FIG. 4(A) shows protective cap 160A in the fully closed position in which plug connector 150A extends through the rear opening into the central cavity of protective cap 160A. Referring briefly to FIG. 1 and to FIG. 2, one or more locking bumps 118A are integrally molded into the L-shaped recess and disposed to engage with end portions of elongated groove 167A when protective cap 160A is disposed in the closed position, thereby preventing unintended opening of cap 160A during transport that could lead to damage or fouling of plug connector 150A. Note that, unlike pins 117A that are substantially cylindrical in shape, bumps 118A have a rounded top to facilitate relatively easy entry and exit from elongated grooves 167A. As indicated in FIG. 4(B), during a first phase of the opening process cap 160A is rotated in the direction of arrow A1 with sufficient force to pull bumps 118A out of elongated grooves 167A. In accordance with another aspect of the invention, pins 117A are pivotably received in grooves 167A such that cap 160A is pivotable relative to housing 110A from the closed position (shown in FIG. 4(A) to the intermediate positions shown in FIGS. 4(B) and 4(C). As mentioned above, as indicated in FIG. 4(B), at least a portion of plug connector 150A passes through side opening 163A2 during this phase of the opening process. By utilizing side opening 163A2 to provide this clearance, the size of cap 160A can be minimized. After protective cap 160A is rotated into the intermediate position shown in FIG. 4(C), protective cap 160A is slid downward relative to housing 110A such that pins 117A slide along the length of elongated grooves 167A, and the lower portion of protective cap 160A is moved downward over the side wall portion of L-shaped groove 116A. When disposed in the fully open position shown in FIG. 4(D), protective cap 160A is substantially fully disposed below an imaginary plane P defined by front wall 111A to facilitate insertion of plug connector 150A into the female plug receptacle of a host system (not shown).

Figure 5:
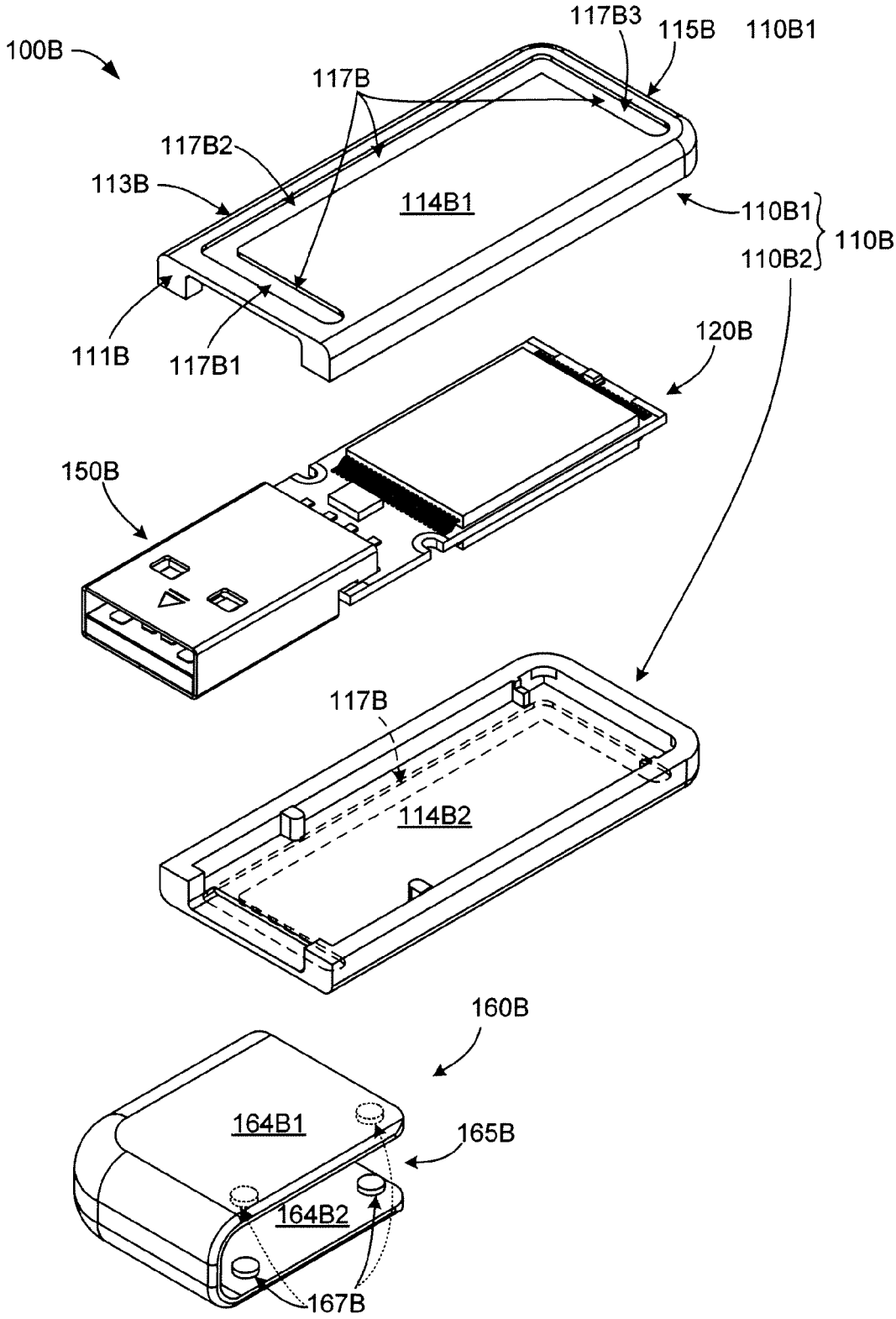
FIG. 5 is an exploded perspective view showing an exemplary USB device according to another embodiment of the present invention.

FIG. 5 is an exploded perspective top view showing a USB device 100B according to another embodiment of the present invention. Similar to USB device 100A, USB device 100B includes a two-part plastic housing 110B made up of upper housing portion 110B1 and lower housing portion 110B2, a PCBA 120B having a plug connector 150B, and a protective cap 160B that remains connected to housing body 110B at all times, thus providing benefits similar to those described above with reference to USB device 100A. PCBA 120B and plug connector 150B are substantially identical to PCBA 120A and connector 150A, and therefore will not be described in additional detail below. In addition, housing portions 110B1 and 110B2 are molded plastic and are shaped and arranged similar to housing portions 110A1 and 110A2, described above, but differ from housing portions 110A1 and 110A2 in the manner described below.

In accordance with an aspect of the present embodiment, USB device 100B differs from USB device 100A in that protective cap 160B includes four pins 167B, with two pins 167B extending from inside facing surfaces of each of lower wall 164B2 and upper wall 164B1, and are disposed at opposite ends of lower opening 165B. In addition, housing portions 110B1 and 110B2 define elongated grooves 117B disposed on outward facing surfaces of upper wall 114B1 and lower wall 114B2, and protective cap 160B is mounted onto housing 110B such that pins 167B are slidably and pivotably received in elongated grooves 117B. This arrangement provides additional reliability by maintaining lower opening 165B against housing 110B, which provides a more secure connection and minimizes extraneous forces that can unintentionally dislodge cap 160B from housing 110B. The process of mounting cap 160B onto housing 110B is similar to that shown and described above with reference to FIGS. 3(A) and 3(B).

Figure 6A:
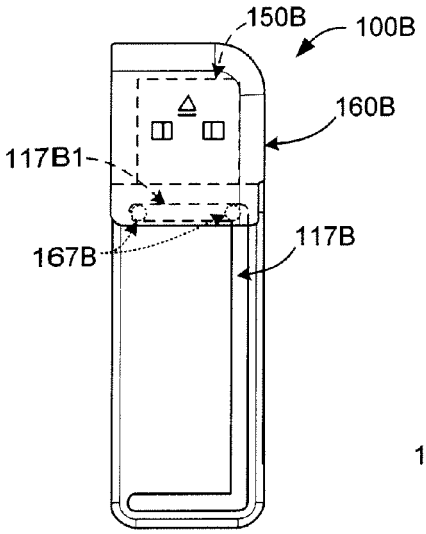
FIGS. 6(A), 6(B), 6(C), 6(D) and 6(E) are simplified plan views showing the USB device of FIG. 6 during repositioning of the protective cap from a protected (traveling) position to a deployed (operating) position.
Figure 6B:
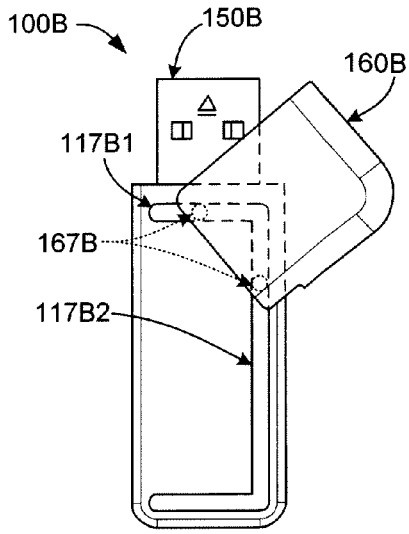
Figure 6C:
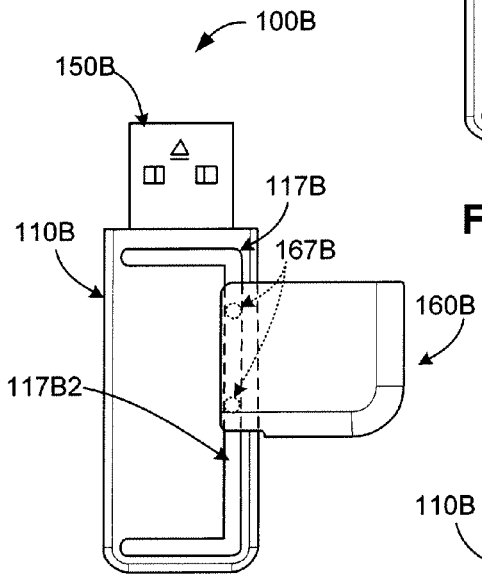
Figure 6D:
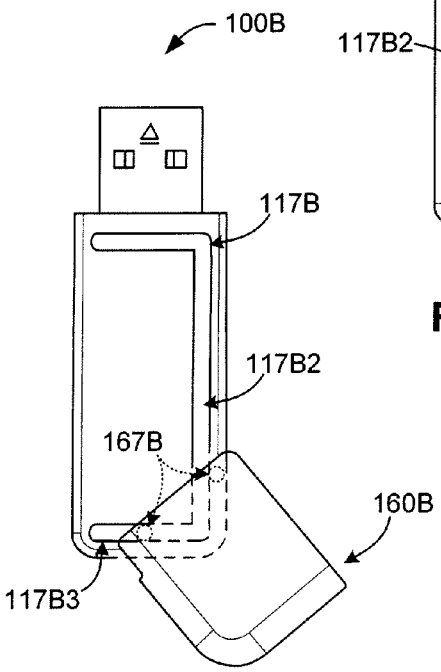
Figure 6E:
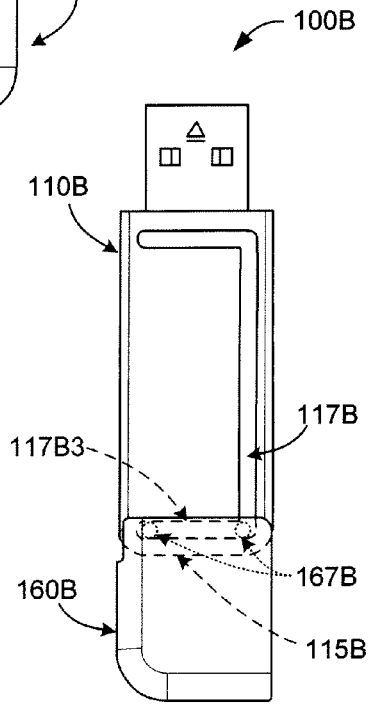

In accordance with another aspect of the present embodiment, referring to the upper portion of FIG. 5, elongated grooves 117B are U-shaped and have a first section 117B1 disposed parallel to front wall (front end portion) 111B of housing, a second section 117B2 disposed parallel to the side wall 113B of the housing, and a third section 117B3 disposed parallel to the rear wall 115B of housing 110B. As illustrated by the sequence of cap positions illustrated in FIGS. 6(A) to 6(E), U-shaped elongated grooves 117B facilitates repositioning of protective cap 160B to a position behind back wall 115B when USB device 100B is fully opened. In particular, FIG. 6(A) shows protective cap 160B in a fully closed position in which all four pins (two shown) are disposed in first section 117B1 of U-shaped grooves 117B, and protective cap 160 entirely covers plug connector 150B. FIG. 6(B) illustrates a first intermediate position of cap 160B during the opening process in which two pins 167B remain located in first section 117B1 of U-shaped grooves 117B, and two pins 167B are moved into second section 117B2 of U-shaped grooves 117B, whereby plug connector 150B passes through a side opening of cap 160B and is partially exposed. FIG. 6(C) illustrates a second intermediate position of cap 160B in which all four pins 167B are slidably received in second section 117B2 of U-shaped grooves 117B, whereby plug connector 150B is now fully exposed, and cap 160B extends from a side of housing 110B. FIG. 6(D) illustrates a fourth intermediate position of cap 160B during the opening process in which two pins 167B remain located in second section 117B2 of U-shaped grooves 117B, and two pins 167B are moved into third section 117B3 of U-shaped grooves 117B, whereby cap 160B begins to pivot behind rear wall 115B of housing 110B. FIG. 6(E) illustrates the fully opened position of cap 160B in which all four pins 167B are slidably received in third section 117B3 of U-shaped grooves 117B, whereby protective cap 160B is positioned over rear wall 115B of housing 110B. This arrangement provides a sleek and easy to hold structure in the fully opened position that may be required when USB device 100B is coupled to some host systems having limited surface space.

Figure 7:
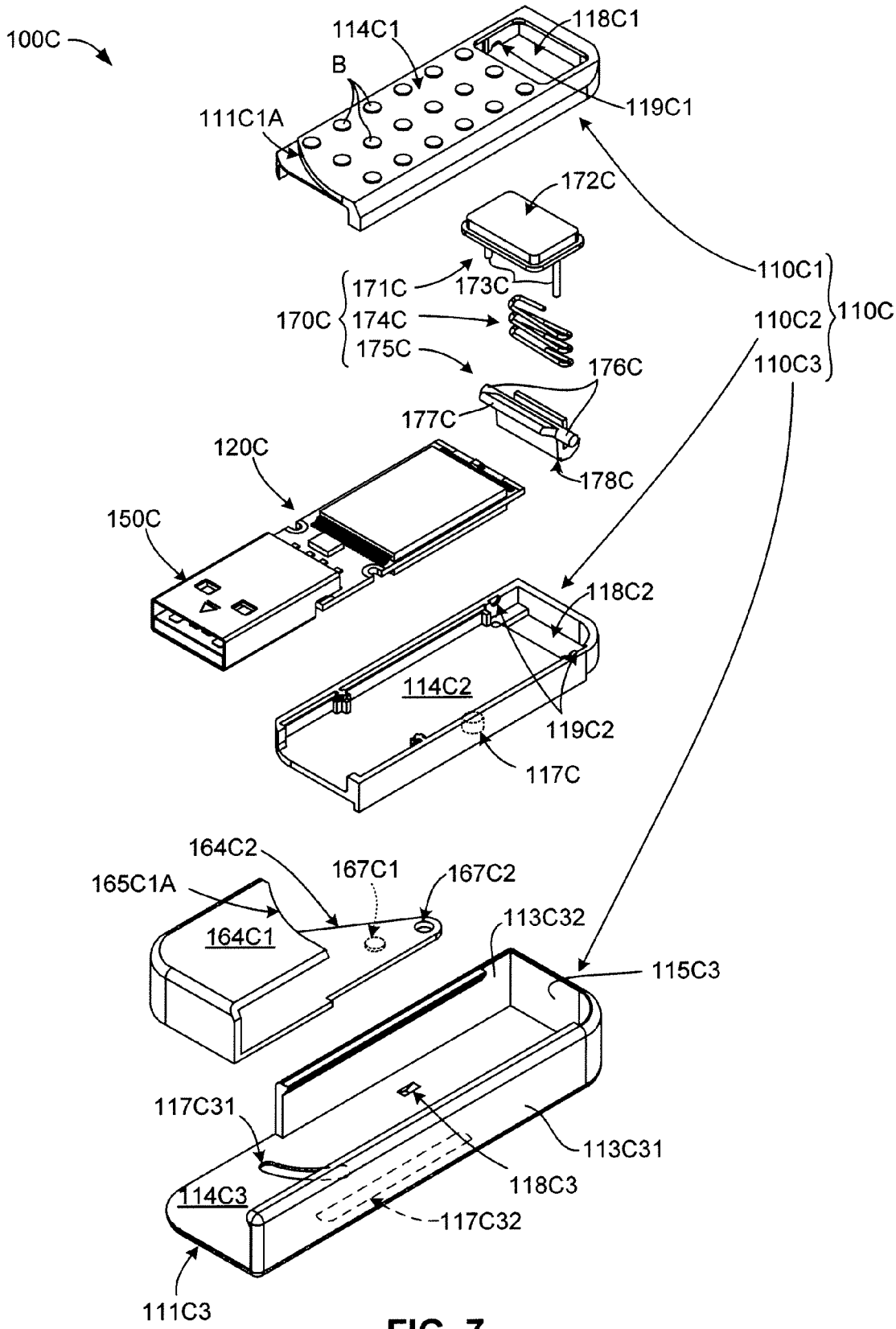
FIG. 7 is an exploded perspective top view showing an exemplary USB device according to another embodiment of the present invention.

FIG. 7 is an exploded perspective top view showing a USB device 100C according to another embodiment of the present invention. USB device 100C includes a three-part plastic housing 110C made up of upper housing portion 110C1, and intermediate housing portion 110C2, and a lower housing portion 110C3, a PCBA 120C having a plug connector 150C, and a protective cap 160C that remains connected to housing body 110C at all times, thus providing benefits similar to those described above with reference to USB devices 100A and 100B. PCBA 120C and plug connector 150C are substantially identical to PCBA 120A and connector 150A, and therefore will not be described in additional detail below.

Housing portions 110C1 and 110C2 are molded plastic structures that are shaped and arranged similar to housing portions 110A1 and 110A2, described above, but differ from housing portions 110A1 and 110A2 in several ways. First, housing portions 110C1 and 110C2 are shaped and arranged to be slidably held by lower housing portion 110C3 in the manner described below. Second, a front wall section 111C1A of upper housing portion 110C1 is provided with a cam-like curved shape that facilitates rotation of cap 160C in the manner described below with reference to FIGS. 10(A) to 10(C). Third, upper wall 114C1 and lower wall 114C2 define openings 118C1 and 118C2, respectively, that facilitate the reception and operation of a push-slide mechanism 170C, which is described below. Fourth, housing portions 110C1 and 110C2 include internal bearing support structures 119C1 and 119C2, respectively, for rotatably supporting a parking stopper structure 175C of push-slide mechanism 170C. Other differences may be observed in FIGS. 7 and 8, such as the provision of nipples on the outer surface of upper housing portion 110C1 that provide more friction to facilitate the manual opening process.

Lower housing portion 110C3 is also a molded plastic structure that is shaped to receive housing portions 110C1 and 110C2 after they are assembled with PCBA 120C in a manner similar to that described above. Housing portion 110C3 includes a long side wall 113C31, a short side wall 113C32, a bottom wall 114C3, and a rear wall 115C3 that form a cavity for receiving housing portions 110C1 and 110C2. A front edge (front end portion) 111C3 of lower housing portion 110C3 is formed by a front edge of bottom wall 114C3 and long side wall 113C31. As indicated in FIG. 7, upper edges of side walls 113C31 and 113C32 include horizontal flanges that serve to hold housing portions 110C1 and 110C2 inside the cavity formed by housing portion 110C3. In addition, an insides surface of lower wall 114C3 is molded to include one curved elongated groove 117C31, one straight elongated groove 117C32, and one or more parking depressions 118C3.

According to an aspect of the present invention, USB device 100C utilizes push-slide mechanism 170C to facilitate opening and closing of cap 160C. In the present embodiment, push-slide mechanism includes a push button 171C, a depress-release (wire coil) spring 174C and parking stopper structure 175C. Push button 171C includes a flat pressing surface 172C that is exposed outside upper housing portion 110C1 when assembled, and two actuation pins 173C that extend below pressing surface 172C. Parking stopper structure 175C includes pivot rods 176C that are received in bearing support structures 119C1 and 119C2, which are formed on housing portions 110C1 and 110C2, respectively, a lever arm 177C that is contacted by actuation pins 173C, and an engagement portion 178C that engages parking depressions 118C3 provided on the inside surface of lower wall 114C3 of lower housing portion 110C3 when cap 160C is in the fully opened and fully closed positions. When assembled, push-slide mechanism 170C is actuated by manually pushing button 171C into housing 110C against the bias of spring 174C, thereby causing pins 173C to press against lever arm 177C, which in turn causes parking stopper structure 175C to rotate around pivot rods 176C, thereby disengaging engagement portion 178C from a corresponding parking depression and allowing sliding movement of housing portions 110C1 and 110C2 inside lower housing portion 110C3 in the manner described below.

Figure 8:
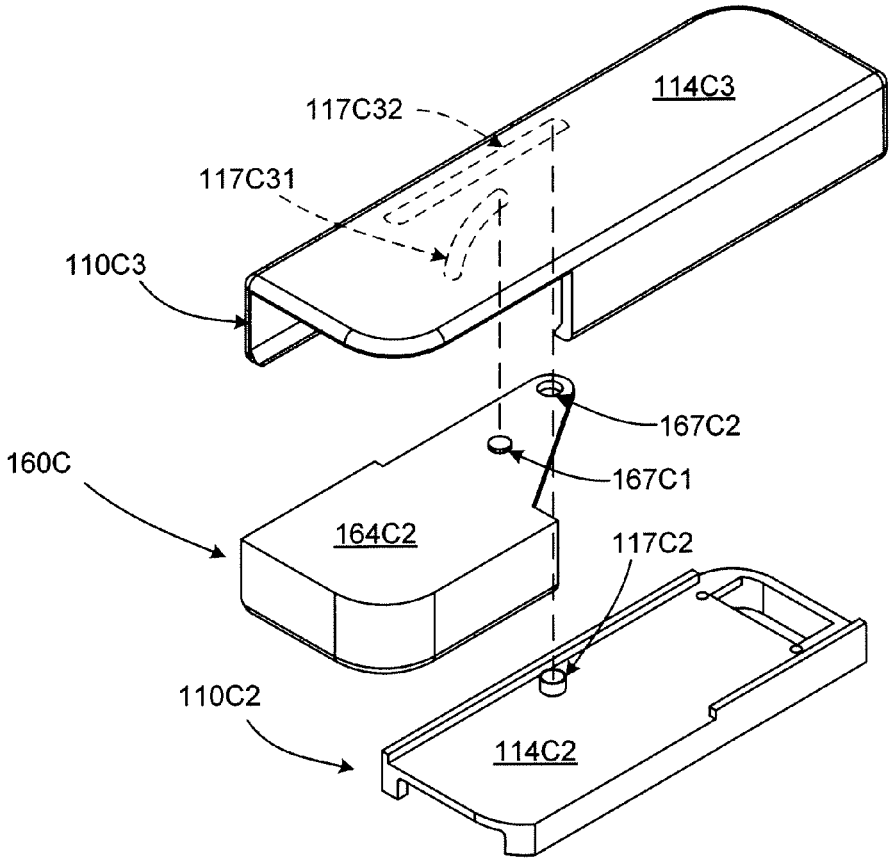
FIG. 8 is an exploded perspective bottom view showing a portion of the USB device of FIG. 7.

In accordance with another aspect of the present embodiment, USB device 100C differs from previous embodiments by including structures that facilitate opening of cap 160C by way of manipulating push-slide mechanism 170C. First, upper wall 164C1 of cap 160C is provided with a curved rear surface 165C1A that slides against front surface portion 111C1A of upper housing portion 110C1 during the opening process. In addition, protective cap 160C includes an elongated lower wall 164C2 including one pin 167C1 (which extends from a lower surface of wall 164C2) and one through-hole 167C2 that cooperate with pin 117C2 and grooves 117C31 and 117C32 in the manner described below with reference to FIGS. 10(A) to 10(C) to facilitate rotational opening of cap 160C relative to housing 110C during the opening process. In particular, as indicated in FIG. 8, USB device 100C is assembled such that pin 167C1 (which is disposed on the lower surface of bottom wall 164C2 of cap 160C) is inserted and slidably received in curved elongated groove 117C31. In addition, USB device 100C is assembled such that pin 117C2 (which is disposed on the lower surface of bottom wall 114C2 on housing portion 110C2) is inserted through hole 167C2 (which is formed through lower wall 164C2 of cap 160C) and is slidably received in straight elongated groove 117C32. As described below, this arrangement facilitates forcible (automatic) rotation of cap 160C from the front to the side of housing 110C during the opening process, and automatic rotation of cap 160C from the opened position to the closed position by manually sliding button 171C (shown in FIG. 7) backward along housing 110C.

Figure 9A:
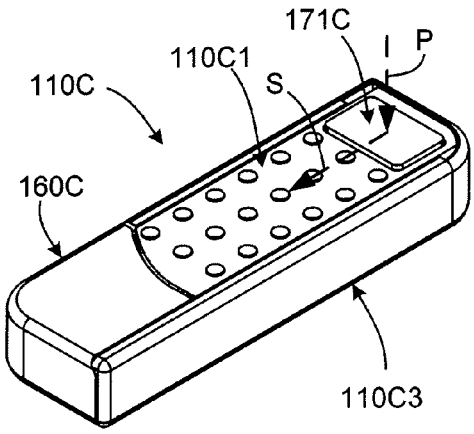
FIGS. 9(A) and 9(B) are perspective top and bottom views, respectively, depicting the USB device of FIG. 7 in an assembled state.
Figure 9B:
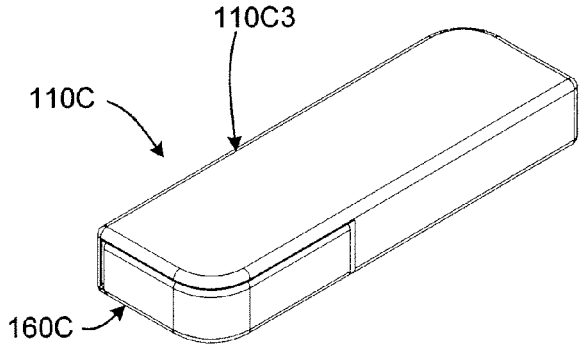

FIGS. 9(A) and 9(B) show USB device 100C in a fully assembled state. An advantage of the present embodiment is that cap 160C is conveniently manipulated by way of the push-lock mechanism controlled by button 171C in the manner described below with reference to FIGS. 10(A) to 10(C). In addition, FIGS. 9(A) and 9(B) illustrate another advantage of USB device 100C in that cap 160C and housing portions 110C1 and 110C3 form a substantially closed container that entirely encloses the PCBA, thereby further protecting the plug connector from damage and fouling due to exposure to the environment.

Figure 10A:
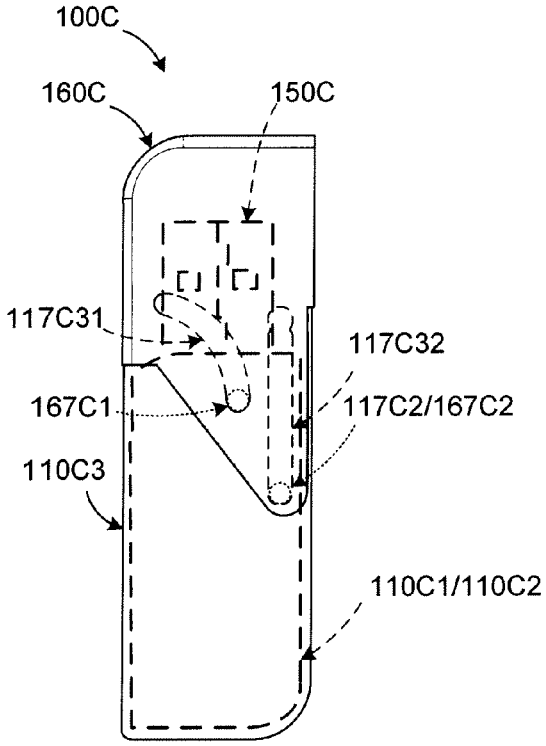
FIGS. 10(A), 10(B) and 10(C) are simplified plan views showing the USB device of FIG. 7 during repositioning of the protective cap from a protected (traveling) position to a deployed (operating) position.
Figure 10B:
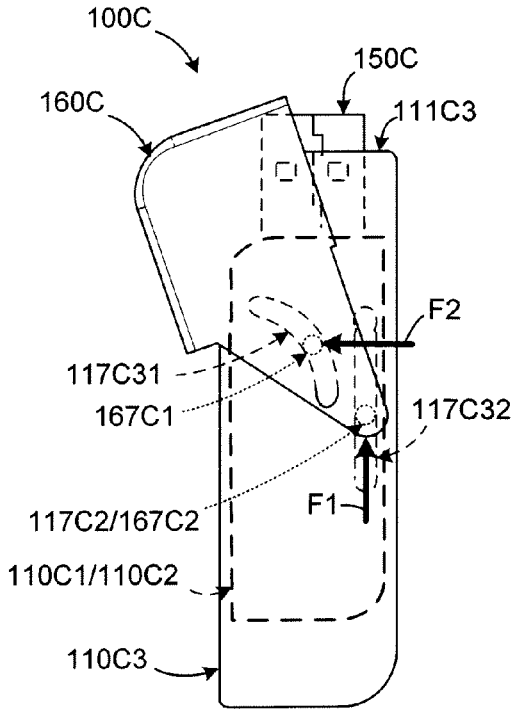
Figure 10C:
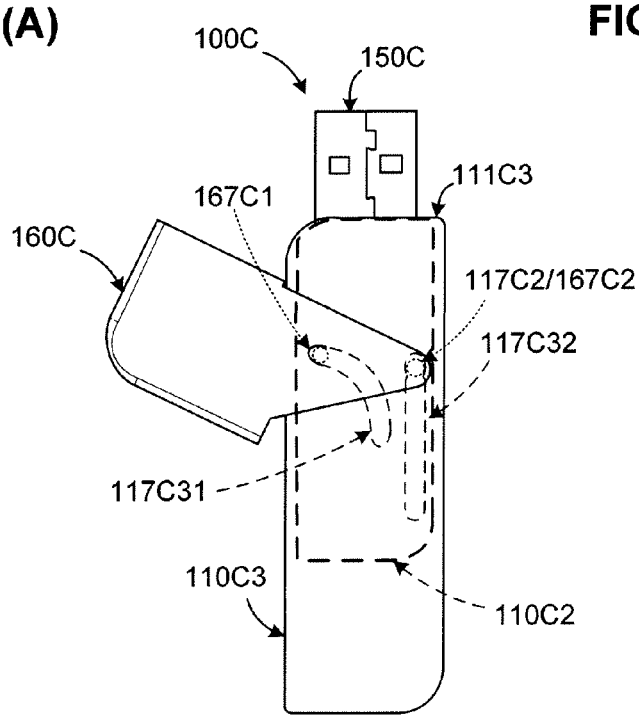

FIGS. 10(A) to 10(C) illustrate USB device 100C during a sequence of cap positions associated with an opening process. In particular, FIG. 10(A) shows protective cap 160C in a fully closed (retracted) position in which pin 167C1 is disposed in a lower end of curved groove 117C31, and pin 117C2 (which extends through opening 167C2) is disposed in a lower end of straight groove 117C32. In this position, housing portions 110C1 and 110C2 remain disposed at a lower end of housing portion 110C3, keeping plug connector 150C fully enclosed within housing 110C. Referring briefly to FIG. 9(A), the opening process is then initiated by pressing button 171C into housing 110C in the direction of dashed-line arrow P to disengage the locking mechanism, and then sliding button 171C forward in the direction of dashed-line arrow S. Referring back to FIG. 10(B), which illustrates a first intermediate position of cap 160C during the opening process, the upward movement of housing portions 110C1 and 110C2 causes pin 167C1 to slide along curved groove 117C31, and causes pin 117C2 to slide along straight groove 117C32. Because pin 117C2 is pivotably disposed in opening 167C2, the upward movement of pin 117C2 generates an upward-directed force F1 on wall 164C2 of cap 160C. In addition, the sliding movement of pin 117C1 along curved groove 117C31 generates an outward-directed force F2 on wall 164C2 of cap 160C. The combined forces F1 and F2 cause cap 160C to being rotating and moving across front edge 111C3, as indicated in FIG. 10(B). In addition, the forward movement of housing portions 110C1 and 110C2 cause plug connector 150C to begin to emerge from front edge 111C3. Note again that an open side of cap 160C allows plug connector 150C to deploy while maintaining cap 160C close to housing 110C3, but in this embodiment housing 110C3 entirely encloses plug connector 150C when cap 160C is in the entirely closed position, as shown in FIG. 9(B). Housing portions 110C1 and 110C2 continue to move forward and cap 160C continues to rotate as button 171C is slid forward. As indicated in FIG. 10(C), when button 171C reaches the front-most end of its travel, cap 160C and housing portions 110C1/110C2 stop at their fully opened (deployed) position, wherein substantially all of cap 160C is disposed behind front edge 111C, and plug connector 150C is disposed for insertion in a host system. The closing operation is performed by reversing the opening process described above.

Figure 11:
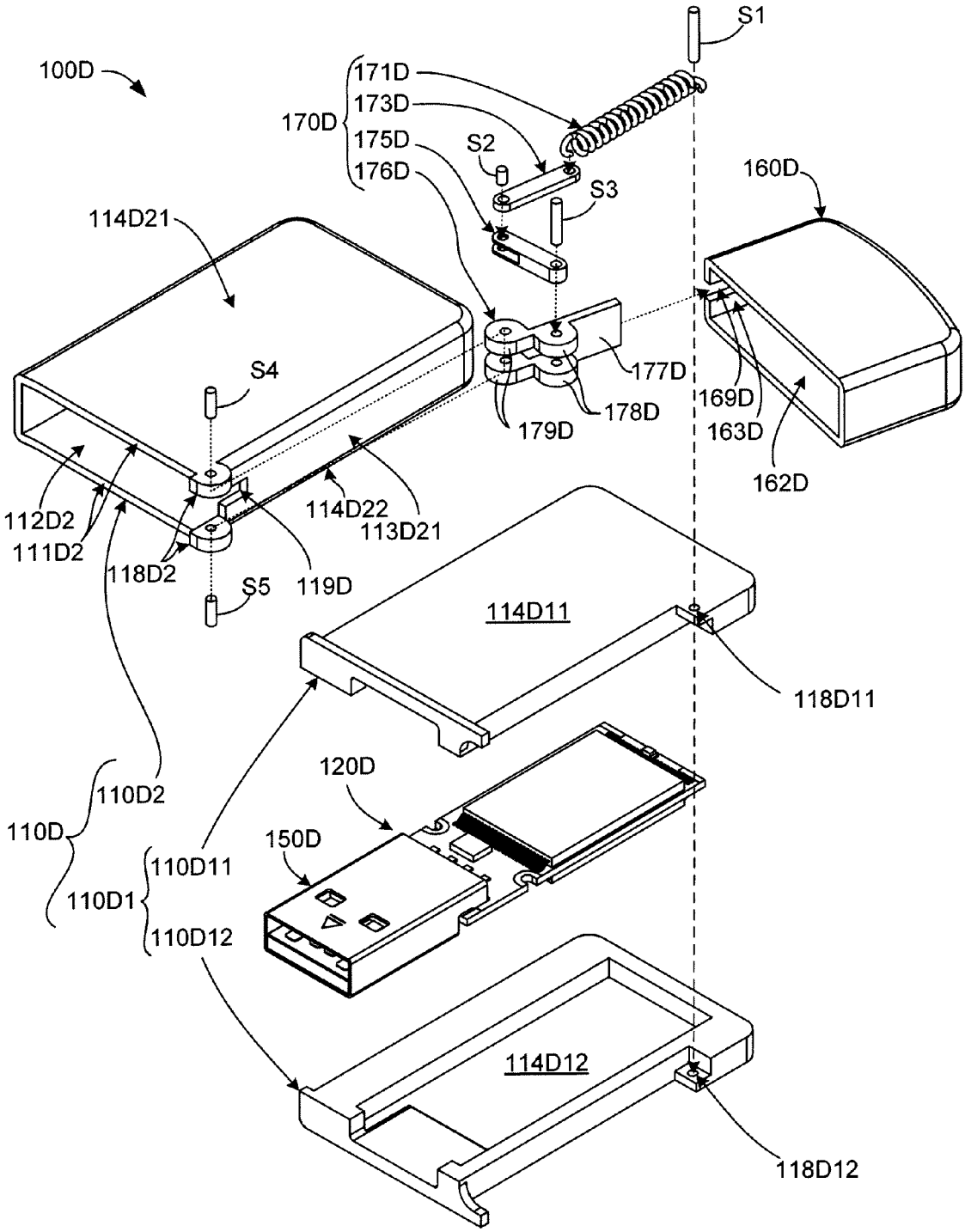
FIG. 11 is an exploded perspective top view showing an exemplary USB device according to yet another embodiment of the present invention.

FIG. 11 is an exploded perspective top view showing a USB device 100D according to another embodiment of the present invention. USB device 100D includes a three-part housing 110D made up of a plastic inner housing 110D1 including an upper inner housing portion 110D11 and a lower inner housing portion 110D12, and a metal outer housing portion 110D2, and a metal protective cap 160D that remains connected to outer housing portion 110D2 at all times, thus providing benefits similar to those described above with reference to USB devices 100A, 100B and 100C. Inner housing portions 110D11 and 110D12 are molded plastic structures that are shaped and arranged similar to housing portions 110A1 and 110A2, described above, but differ from housing portions in that their external surfaces are shaped to fit snuggly inside outer housing portion 110D2, and connection flanges 118D11 and 118D12 are respectively provided on upper wall 114D11 and lower wall 114D12. Outer housing portion 110D2 is stamped or otherwise formed from sheet metal, and includes upper and lower walls 114D21 and 114D22 that define a front edge (front end portion) 111D2 and a front opening 112D2 into an interior cavity. Upper and lower walls 114D21 and 114D22 include flanges 118D11 and 118D12, respectively, that are integrally formed and disposed adjacent to front edge 111D2, and a side wall 113D21 defines a gap 119D disposed between donut structures 118D2. Metal cap 160D is a box-like structure having a lower opening 162D, and a side wall 163D of cap 160D defines a gap 169D.

According to an aspect of the present embodiment, metal outer housing portion 110D2 and metal cap 160D form a "generic" external metal shell that entirely encloses PCBA 150D when protective cap 160D is in its closed position, and the metal shell is capable of housing several types of electronic devices by modifying plastic inner housing 110D1 that is inserted inside metal outer housing portion 110D2. In the present embodiment, a PCBA 120D having a plug connector 150D is mounted inside plastic inner housing 110D1, and the assembly is then inserted through front opening 112D2 of outer housing portion 110D2. This arrangement facilitates low-cost changes to the electronics housed in device 100D because changing plastic inner housing 110D1 to support a different PCB type merely requires, e.g., corresponding changes to the plastic mold used to form upper and lower portions 100D11 and 110D12, whereas changes to outer housing portion 110D2 and protective cap 160D, which are made of metal, requires substantially more effort. That is, in the disclosed embodiment, PCBA 120D and plug connector 150D are substantially identical to PCBA 120A and connector 150A, and therefore will not be described in additional detail below. However, as set forth in the following embodiments, PCBA 120D may be replaced with another PCBA type simply by providing a different plastic inner housing, allowing metal outer housing portion 110D2 to be utilized for several types of computer peripheral devices, thus minimizing manufacturing costs while maximizing manufacturing flexibility.

According to another aspect of the present embodiment, a spring mechanism 170D is connected between metal cap 160D and outer metal housing 110D to facilitate stably holding cap 160D in a stationary position when cap 160D is in its fully opened and fully closed positions. In the present embodiment, spring mechanism 170D includes a coils spring 171D, a lower arm 173D, an upper arm 175D, and a donut pairs structure 176D. Spring 171D is a metal coils spring having hook features disposed at each end. Lower arm 173D and upper arm 175D are metal linkage structures having connection holes disposed at each end. Donut pairs structure 176D is an integrally molded or forged structure including a flat connection plate 177D, an upper donut pair 178D, and a lower donut pair 179D, where a gap is provided between each set of donut pairs that aligns with gap 169D of cap 160D.

Assembly of USB device 100D involves sandwiching PCBA 120D between upper and lower inner housing portions 110D11 and 110D12, and connecting one end of spring 171D to flanges 118D11 and 118D12 using a first metal screw S1. The second end of spring 171D is attached to a first end of lower arm 173D, and the second end of lower arm 173D is connected to a first end of upper arm 175D using a second screw S2. The second end of upper arm 175D is connected to upper donut pair 178D using a third screw S3. Connection plate 177D is welded or otherwise secured to the inside surface of side wall 163D on cap 160D, and then cap 160D is pivotably connected to metal outer housing portion 110D2 by connecting lower donut pair 179D to donut structures 118D2 using screws S4 and S5.

Figure 12A:
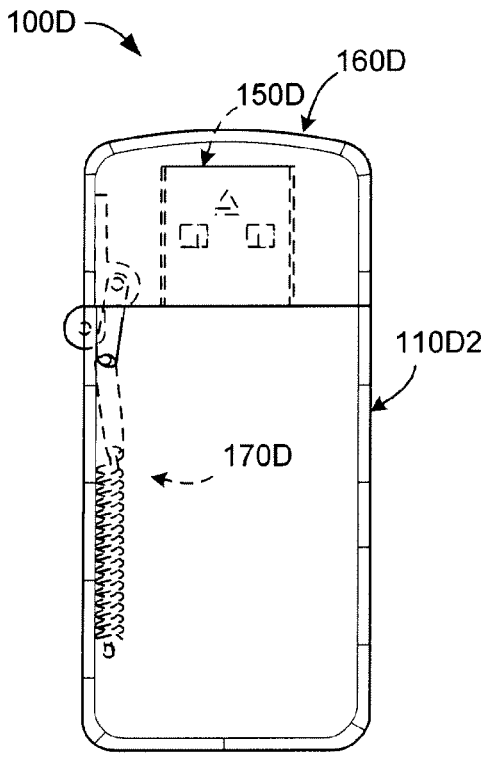
FIGS. 12(A), 12(B) and 12(C) are simplified plan views showing the USB device of FIG. 11 during repositioning of the protective cap from a protected (traveling) position to a deployed (operating) position.
Figure 12B:
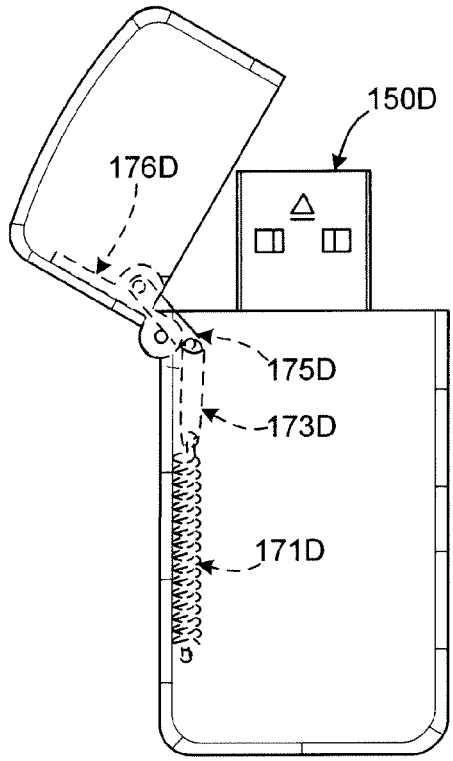
Figure 12C:
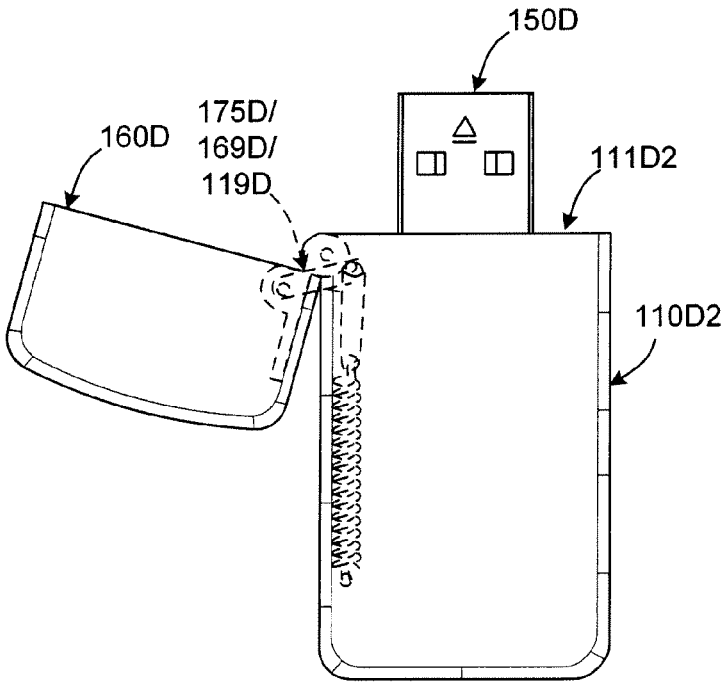

FIGS. 12(A) to 12(C) illustrate USB device 100D during a sequence of cap positions associated with an opening process. In particular, FIG. 12(A) shows protective cap 160D in a fully closed position in which plug connector 150D is fully enclosed by cap 160D. Note that cap 160D is held in the closed position by the downward bias provided by spring mechanism 170D. The opening process is then initiated by manually lifting/rotating protective cap 160D against the spring bias into the intermediate position shown in FIG. 12(B). Note that because cap 160D does not include a side opening in this embodiment, a larger clearance is required in order to facilitate the opening process without causing contact between plug connector 150D and cap 160D. The rotation of cap 160D causes donut pairs structure 176D to rotate away from outer housing portion 110D2, which lifts (pulls) upper swing arm 175 and lower swing arm 173D upward, which in turn stretches spring 171D. Further rotation of cap 160D produces further lifting of the swing arms and stretching of the spring until, when the cap is fully opened as shown in FIG. 12(C), upper swing arm 175D rotates downward into gaps 169D and 119D provide on cap 160D and outer housing portion 110D2, respectively, whereby the balance of forces locks cap 160D in this fully opened position, wherein substantially all of cap 160D is disposed behind front edge 111D, and plug connector 150D is disposed for insertion in a host system.

Figure 13:
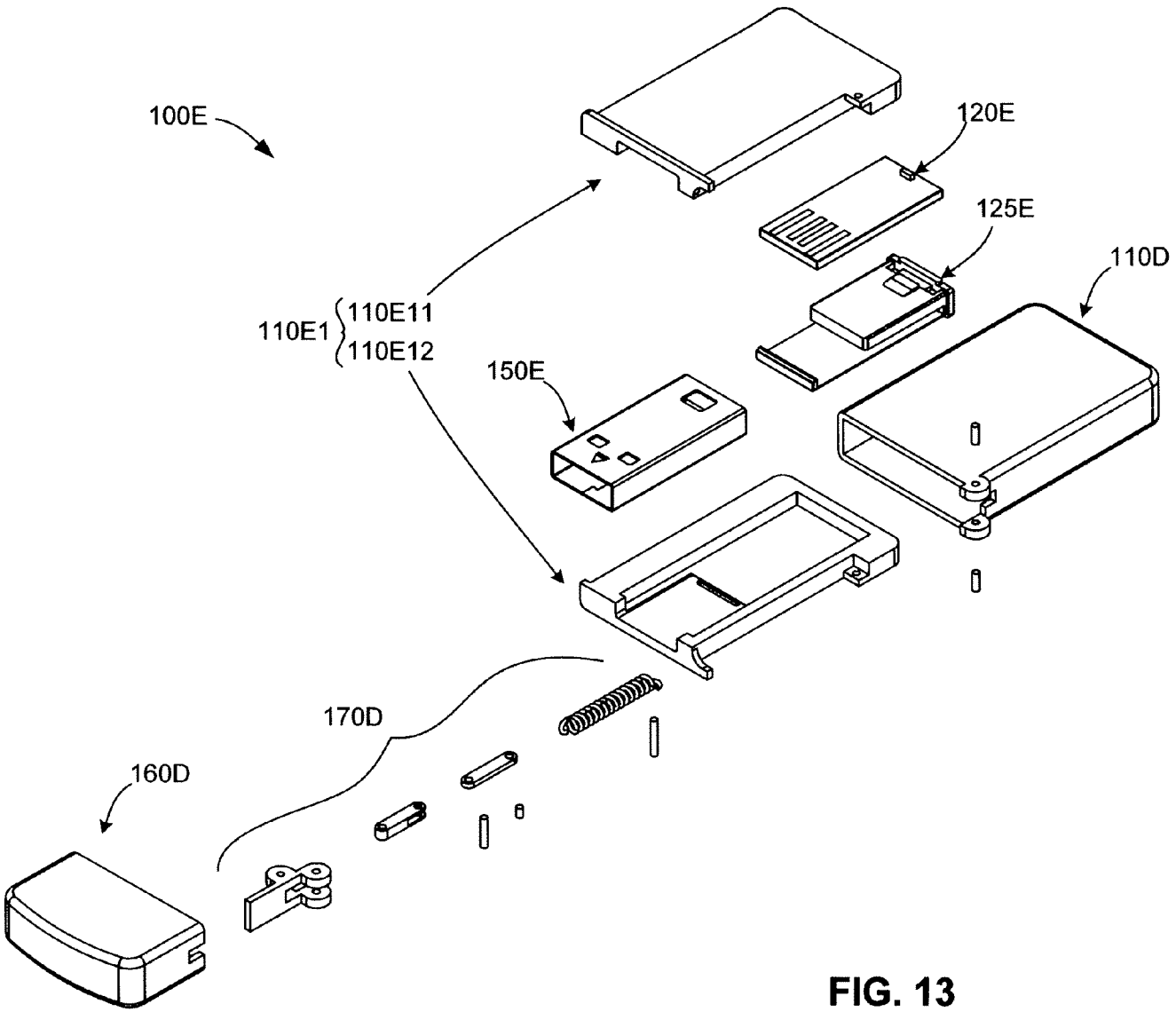
FIG. 13 view perspective view showing an exemplary USB device utilizing a chip-on-board (COB) PCBA according to yet another embodiment of the present invention.
Figure 14:
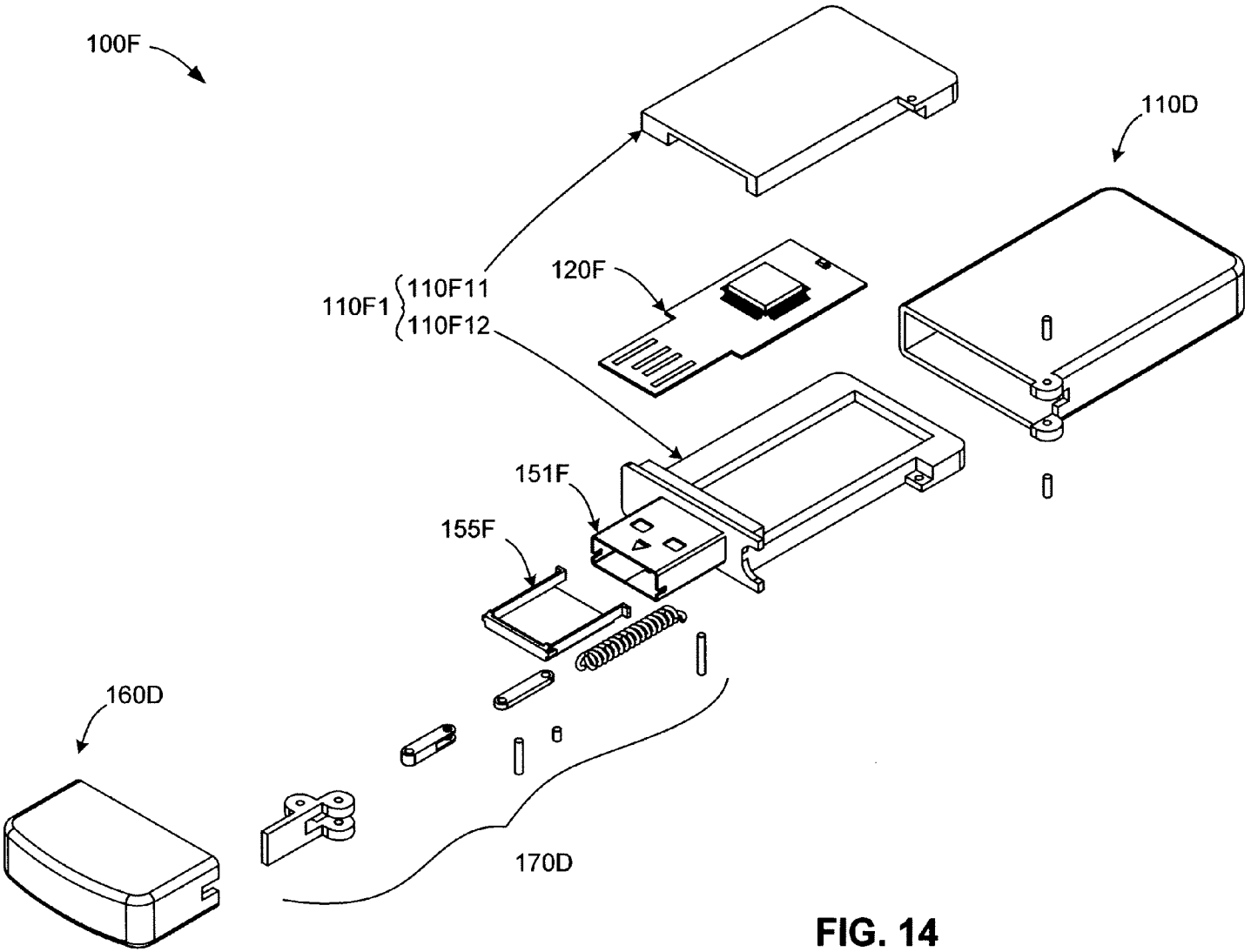
FIG. 14 view perspective view showing an exemplary USB device utilizing a surface mount technology (SMT) PCBA according to yet another embodiment of the present invention.

FIGS. 13 and 14 depict alternative embodiments of USB device 100D that incorporate alternative circuit structures, thereby illustrating a benefit of utilizing a "generic" metal external housing structure 110D2, protective cap 160D, and spring mechanism 170D.

FIG. 13 shows a USB device 100E that utilizes metal outer housing portion 110D2, protective cap 160D and spring mechanism 170D, which are described above, but utilizes a modified inner plastic housing 110E that supports a molded, single piece chip-on-board (COB) type PCBA 120E and an associated substrate carrier 125E. PCBA 120E includes standard USB metal contacts formed on a first (e.g., upper) surface of a PCB, and all IC components (e.g., USB controller chip, flash memory chip, etc.) mounted on the opposite (e.g., lower) surface of the PCB. A molded casing is then mounted or otherwise formed over the IC components (i.e., over the lower surface of the PCBA). The casing has a planar surface that is parallel to the PCB and extends along the entire length of the PCBA (e.g., from a front edge of the plug structure to a rear edge of the PCB). Accordingly, PCBA 120E is a flat, low-profile (thin) structure that can be easily incorporated into USB device 100E, e.g., using substrate carrier 125E and a rectangular tube-like plug connector 125E.

FIG. 14 shows a USB device 100F that also utilizes metal outer housing portion 110D2, protective cap 160D and spring mechanism 170D, which are described above, but utilizes another modified inner plastic housing 110F that supports a slim profile PCBA 120F that is produced using a SMT process. PCBA 120F is mounted onto lower inner housing portion 110F12, which includes metal plug connector shell 151F integrally molded hereon. A plastic substrate carrier 155F is inserted into the front opening of shell 151F and supports the front (plug) portion of PCBA 120F.

Although the present invention has been described with respect to certain specific embodiments, it will be clear to those skilled in the art that the inventive features of the present invention are applicable to other embodiments as well, all of which are intended to fall within the scope of the present invention. For example, those skilled in the art will recognized that each of USB devices 110A, 100B and 100C may be modified in a manner similar to that described above with reference to USB device 100D to implement COB-type and SMT-type USB PCBAs. In addition, the various device structures may be modified to implement other types of portable computer peripheral apparatus, for example, by modifying the plug connector to include an interface circuit and plug structure that supports Secure Digital (SD), Micro SD, Multi-Media Card (MMC), Compact Flash (CF), Memory Stick (MS), PCI-Express, a Integrated Drive Electronics (IDE), Serial Advanced Technology Attachment (SATA), external SATA, Radio Frequency Identification (RFID), fiber channel and optical connection protocols.

The invention claimed is:

1. A portable computer peripheral apparatus comprising:

a housing having a front end portion defining a front opening, opposing side walls and opposing upper and lower walls extending back from the front end portion and defining a central cavity, and a rear wall covering a back portion of the central cavity;

at least one electronic device mounted inside of the housing;

a plug connector electronically connected to said at least one electronic device; and a protective cap pivotably connected to the housing such that the protective cap is pivotable between an opened position in which said protective cap is disposed behind the front end portion such that said plug connector is exposed for operable coupling to a host system through said front opening, and a closed position in which said cap is disposed over the front end portion of the housing, wherein one of the housing and the protective cap includes one or more pins and the other of the housing and the protective cap defines at least one elongated groove, and wherein the protective cap is secured to the housing such that the protective cap remains connected to the housing during movement between the opened and closed positions, and such that said one or more pins are slidably and pivotably received in said one or more grooves during said movement between the opened position and the closed position.

2. The portable computer peripheral apparatus according to claim 1, wherein the protective cap further comprises opposing upper and lower walls that are substantially co-planar with the opposing upper and lower walls of the housing in both the opened and closed positions, and while the protective cap is disposed between the opened and closed positions.

3. The portable computer peripheral apparatus according to claim 1, wherein the protective cap comprises a box-like structure having a rear opening defined such that the plug connector extends through the rear opening into the protective cap when the protective cap is in the closed position, and a side opening disposed such that, when the protective cap is moved from the closed position to the open position, at least a portion of the plug connector extends through the side opening.

4. The portable computer peripheral apparatus according to claim 3, wherein the protective cap comprises first and second pins extending from inside facing surfaces of the protective cap, wherein the housing defines first and second elongated grooves disposed on opposing walls of the housing, and wherein the protective cap is mounted onto the housing such that the first and second pins are slidably and pivotably received in the first and second grooves, respectively.

5. The portable computer peripheral apparatus according to claim 4, wherein the first and second grooves are U-shaped and have a first section disposed parallel to the front end portion of the housing, a second section disposed parallel to the side walls of the housing, and a third section disposed parallel to the rear wall of the housing, whereby the protective cap is positioned over the rear wall of the housing when the protective cap is moved to the opened position.

6. The portable computer peripheral apparatus according to claim 1, wherein the protective cap comprises a pin extending from an outward facing surface of the protective cap, wherein the housing defines a curved groove disposed on an inside surface of the housing, and wherein the protective cap is mounted onto the housing such that the pin is slidably received in the curved groove such that the protective cap is forcibly rotated between the opened and closed positions by sliding of said pin in said curved groove.

7. The portable computer peripheral apparatus according to claim 1, wherein the housing further comprises first and second housing portions that are fixedly connected to the PCBA, and a third housing portion that is slidably connected to the first and second housing portions such that when the protective cap is in the closed position, the first and second housing portions are in a retracted position relative to the third housing portion such that the plug connector is disposed inside the third housing portion, and when the protective cap is moved from the closed position to the opened position, the first and second housing portions are moved relative to the third housing portion into a deployed position such that the plug connector is disposed through the front end portion.

8. The portable computer peripheral apparatus according to claim 7, wherein the third housing portion defines a curved groove and a straight groove located adjacent to the curved groove, wherein the protective cap includes a first pin slidably received in the curved groove defined by the third housing portion, the protective cap also defining a through-hole, and wherein the second housing portion comprises a second pin that extends through the through-hole defined in the protective cap and is slidably received in the straight groove defined in the third housing portion.

9. The portable computer peripheral apparatus according to claim 7, further comprising a push-slide mechanism for manually moving the first and second housing portions between the retracted and deployed positions.

10. The apparatus of claim 1, wherein the plug connector includes an interface circuit including means for implementing one of a Universal Serial Bus (USB), a Secure Digital (SD), a Micro SD, Multi-Media Card (MMC), a Compact Flash (CF), a Memory Stick (MS), a PCI-Express, a Integrated Drive Electronics (IDE), a Serial Advanced a Technology Attachment (SATA), an external SATA, a Radio Frequency Identification (RFID), a fiber channel and an optical connection protocol.

11. A portable computer peripheral apparatus comprising:

a housing having a front end portion defining a front opening, opposing side walls and opposing upper and lower walls extending back from the front end portion and defining a central cavity, and a rear wall covering a back portion of the central cavity;

at least one electronic device mounted inside of the housing;

a plug connector electronically connected to said at least one electronic device; and a protective cap pivotably connected to the housing such that the protective cap is pivotable between an opened position in which said protective cap is disposed behind the front end portion such that said plug connector is exposed for operable coupling to a host system through said front opening, and a closed position in which said cap is disposed over the front end portion of the housing, wherein the protective cap is secured to the housing such that the protective cap remains connected to the housing during movement between the opened and closed positions, wherein the protective cap comprises a box-like structure having a rear opening defined such that the plug connector extends through the rear opening into the protective cap when the protective cap is in the closed position, and a side opening disposed such that, when the protective cap is moved from the closed position to the open position, at least a portion of the plug connector extends through the side opening, and wherein the housing comprises first and second pins extending from opposite sides of the housing adjacent to the front portion, wherein the protective cap defines first and second elongated grooves disposed on inside facing surfaces of the protective cap, and wherein the protective cap is mounted onto the housing such that the first and second pins are slidably and pivotably received in the first and second grooves, respectively.

12. The portable computer peripheral apparatus according to claim 11, wherein the housing defines an L-shaped recess extending along the front end portion and one of said side walls of the housing, and wherein a portion of the protective cap is received in the L-shaped recess when the protective cap is in the opened and closed positions.

13. The portable computer peripheral apparatus according to claim 12, wherein the cap is pivotably mounted to the housing such that the first and second pins rotate in the first and second grooves, respectively, when the protective cap is moved from the closed position to an intermediate position between the opened position and the closed position, and wherein the protective cap is slidably mounted to the housing such that the first and second pins slide in the first and second grooves, respectively, when the protective cap is moved from the intermediate position to the opened position.

14. The portable computer peripheral apparatus according to claim 12, wherein the housing comprises first and second locking bumps disposed in the L-shaped recess that engage with end portions of said first and second grooves when the protective cap is disposed in the closed position.

* * * * *